US012402715B1

(12) United States Patent
Joshi et al.

(10) Patent No.: US 12,402,715 B1
(45) Date of Patent: Sep. 2, 2025

(54) SHOULDER STRAP

(71) Applicants: Shailendra Joshi, Ho Ho Kus, NJ (US); Vidur Joshi, Ho Ho Kus, NJ (US)

(72) Inventors: Shailendra Joshi, Ho Ho Kus, NJ (US); Vidur Joshi, Ho Ho Kus, NJ (US)

( * ) Notice: Subject to any disclaimer, the term of this patent is extended or adjusted under 35 U.S.C. 154(b) by 154 days.

(21) Appl. No.: 18/397,345

(22) Filed: Dec. 27, 2023

(51) Int. Cl.
*A45F 3/14* (2006.01)
*A45F 3/02* (2006.01)
*A45F 3/04* (2006.01)

(52) U.S. Cl.
CPC ..... *A45F 3/14* (2013.01); *A45F 3/02* (2013.01); *A45F 3/04* (2013.01); *A45F 2003/142* (2013.01)

(58) Field of Classification Search
CPC ..... A45F 3/12; A45F 3/14; A45F 2003/142; A45F 2003/146; A45F 2003/148
USPC ..... 224/257, 264, 258, 259, 260, 261, 262, 224/263
See application file for complete search history.

(56) References Cited

U.S. PATENT DOCUMENTS 2,608,326 A * 8/1952 Spector ..... A45F 3/12 224/264
2,633,573 A * 4/1953 Sanders ..... A41F 15/007 224/264
2,654,887 A * 10/1953 Hookstratten ..... A41F 15/007 224/264
2,808,973 A * 10/1957 Gobble ..... A45F 3/12 224/264
4,125,904 A * 11/1978 Levine ..... A45F 3/12 2/267
4,472,838 A * 9/1984 Pompa ..... A41F 15/007 2/460
4,612,935 A * 9/1986 Greifer ..... A41F 15/002 2/268
4,795,399 A * 1/1989 Davis ..... A41F 15/007 2/268
4,887,318 A * 12/1989 Weinreb ..... A45F 3/12 224/264
5,282,558 A * 2/1994 Martinez ..... F41C 33/002 224/602
5,388,743 A * 2/1995 Silagy ..... A45F 3/12 224/264

(Continued)

*Primary Examiner* — Nathan J Newhouse
*Assistant Examiner* — Lester L Vanterpool
(74) *Attorney, Agent, or Firm* — Gulf Coast Intellectual Property Group

(57) ABSTRACT

A shoulder strap that is configured to provide distribution of the load to an increased area across the shoulder. The present invention includes a primary strap member having two ends that are operably coupled to an item such as but not limited to a luggage bag. A first support member is operably coupled to the primary strap member utilizing securing members. The first support member is configured to be operably coupled to a secondary support member wherein the first support member is placed in a bowed or arcuate position subsequently being operably coupled to the secondary support member. The secondary support member is planar in manner manufactured from flexible material and includes a first receiving pocket member and a second receiving pocket member on opposing ends thereof configured to receive opposing ends of the first support member. The first support member includes at least one alternative embodiment.

6 Claims, 5 Drawing Sheets

(56) References Cited

U.S. PATENT DOCUMENTS

| | | | | | |
|---|---|---|---|---|---|
| 5,474,487 | A | * | 12/1995 | Roush | A41F 15/02 2/112 |
| 5,551,614 | A | * | 9/1996 | Ham | A45F 3/12 224/264 |
| D442,351 | S | * | 5/2001 | Moxey, Jr. | D2/639 |
| D475,176 | S | * | 6/2003 | Moxey, Jr. | D2/639 |
| D488,924 | S | * | 4/2004 | Miller | D3/228 |
| 8,708,207 | B2 | * | 4/2014 | Wetzsteon | A45F 3/12 224/264 |
| 8,973,875 | B2 | * | 3/2015 | Cuadrado | A63B 69/305 248/689 |
| 9,746,165 | B2 | * | 8/2017 | Ritter | F21V 21/145 |
| D837,683 | S | * | 1/2019 | Browne | D11/200 |
| D942,024 | S | * | 1/2022 | Krug | D24/190 |
| 11,672,323 | B2 | * | 6/2023 | Swaggart | A01K 27/003 224/264 |
| 2008/0006661 | A1 | * | 1/2008 | Godshaw | A45C 13/30 224/264 |

* cited by examiner

SHOULDER STRAP

FIELD OF THE INVENTION

The present invention relates generally to carrying straps for bags and the like, more specifically but not by way of limitation a shoulder strap configured to be operably secured to items such as but not limited to luggage bags wherein the present invention is structured so as to diffuse the carrying load over a greater surface area than a traditional shoulder strap.

BACKGROUND

Millions of people travel and commute to work or school carrying various types of bags on a daily basis. By way of example but not limitation, individuals carry items such as but not limited to backpacks, brief cases and duffel bags whether for work or traveling. These conventional bags are often equipped with handles as well as a shoulder strap. The conventional shoulder strap is typically an elongated strap that is coupled to opposing ends of the item and is draped over the shoulder of the user so as to provide a technique of carrying the item utilizing the shoulder.

Conventional shoulder straps traditionally rely on padding to soften the contact with the skin and decrease the impact force. While this is somewhat effective padding can be compressed and displaced and will its intended objective of comfort to the user is diminished. Furthermore, these conventional strap designs do not increase the area of load distribution. As traditional straps have an area of contact that is small, the load of the straps puts considerable pressure on a small area of the shoulder area, particularly over the collarbone. Furthermore, several sub-cutaneous nerves are in the area between the neck and shoulder muscles and when these nerves are compressed it results in discomfort to the user. These problems exist for double strap configurations such as but not limited to a backpack and further exist for single strap applications as well.

Accordingly, there is a need for a shoulder strap that is configured to provide load distribution across a greater area of the shoulder so as to decrease the discomfort to the user carrying the item utilizing the strap of the present invention.

SUMMARY OF THE INVENTION

It is the object of the present invention to provide a shoulder strap configured to be operably coupled to a plurality of alternate items such as but not limited to duffel bags and backpacks wherein the present invention includes a primary strap member having a first end and a second end secured to the item.

Another object of the present invention is to provide a shoulder strap that is configured to provide an increased load distribution area across a user's shoulder wherein the present invention includes a first support member that is oval in shape having a first end and a second end.

A further object of the present invention is to provide a shoulder strap configured to be operably coupled to a plurality of alternate items such as but not limited to duffel bags and backpacks wherein the first support member includes securing members that are configured to encircle the primary strap member so as to operably coupled thereto.

Yet a further object of the present invention is to provide a shoulder strap that is configured to provide an increased load distribution area across a user's shoulder that further includes a secondary support member wherein the secondary support member is adjacent the first support member and distal to the primary strap member.

Still another object of the present invention is to provide a shoulder strap configured to be operably coupled to a plurality of alternate items such as but not limited to duffel bags and backpacks wherein the secondary support member includes receiving members formed at each end thereof that are configured to have the first end and second end of the first support member journaled thereinto.

An additional object of the present invention is to provide a shoulder strap that is configured to provide an increased load distribution area across a user's shoulder wherein the first support member includes a plurality of cross members that are integrally formed with a circumferential support member.

Yet a further object of the present invention is to provide a shoulder strap configured to be operably coupled to a plurality of alternate items such as but not limited to duffel bags and backpacks wherein the first support member has a center cross member having a width greater than cross members laterally present thereto.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
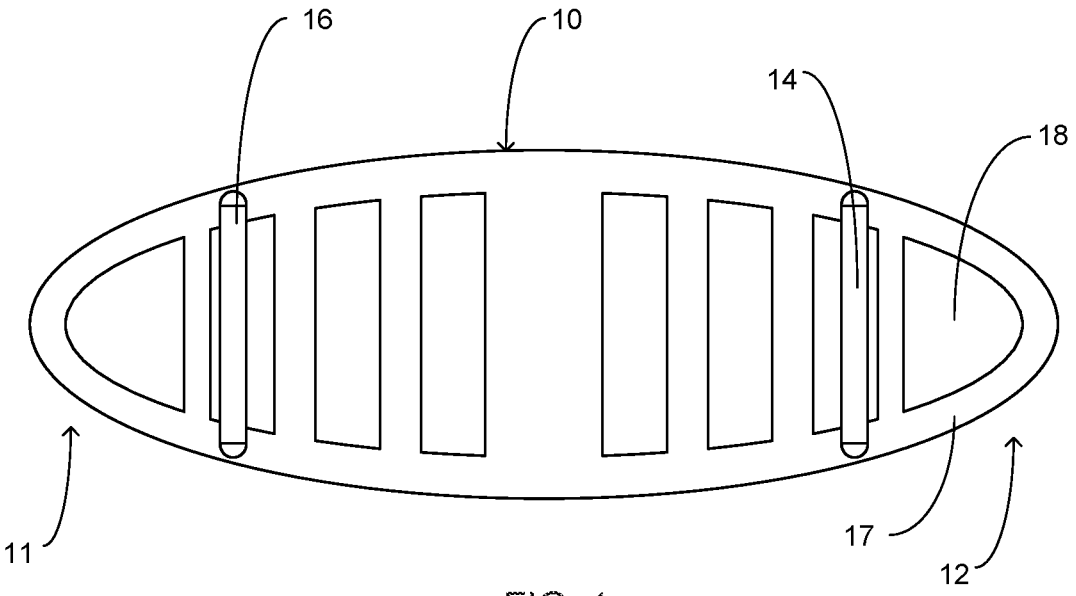
FIG. 1 is a top view of an embodiment of the first support member of the present invention.

Referring now to the drawings submitted herewith, wherein various elements depicted therein are not necessarily drawn to scale and wherein through the views and figures like elements are referenced with identical reference numerals, there is illustrated a shoulder strap 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the shoulder strap 100 includes a first support member 10 wherein the first support member 10 is manufactured from a resilient material such as but not limited to plastic. The first support member 10 includes a first end 11 and a second end 12 and is manufactured to be generally oval in shape wherein the midpoint of the first support member 10 has the greatest width. The first support member 10 includes securing members 14,16 that are integrally formed therewith. The securing members 14, 16 are configured to operably couple to the primary strap member 5 and maintain engagement therewith. The primary strap member 5 is an elongated strap that includes two ends operably coupled to an item such as but not limited to a luggage bag. It should be understood that while a single shoulder application is illustrated and discussed herein, the shoulder strap 100 could be employed on alternate applications that utilize two straps such as but not limited to backpacks.

The first support member 10 includes a perimeter member 17 that defines the shape of the first support member 10 wherein the perimeter member 17 further defines a void 18 within the boundary thereof. A plurality of cross support members 20 are integrally formed with the perimeter member 17 being generally perpendicular thereto extending across the void 18. A central cross support member 22 is located proximate the midpoint of the first support member 10 and is manufactured to have a greater width than the cross support members 20. As is further discussed herein, ensuing operable coupling of the first support member 10 with the secondary support member 30, the structure of the first support member 10 functions to distribute the force of the load towards the first end 11 and second end 12 so as to avoid the full weight force of the load from the primary strap member 5 being at the midpoint of the first support member 10 thus transferring the load force to a greater surface area of the shoulder 99.

Figure 2:
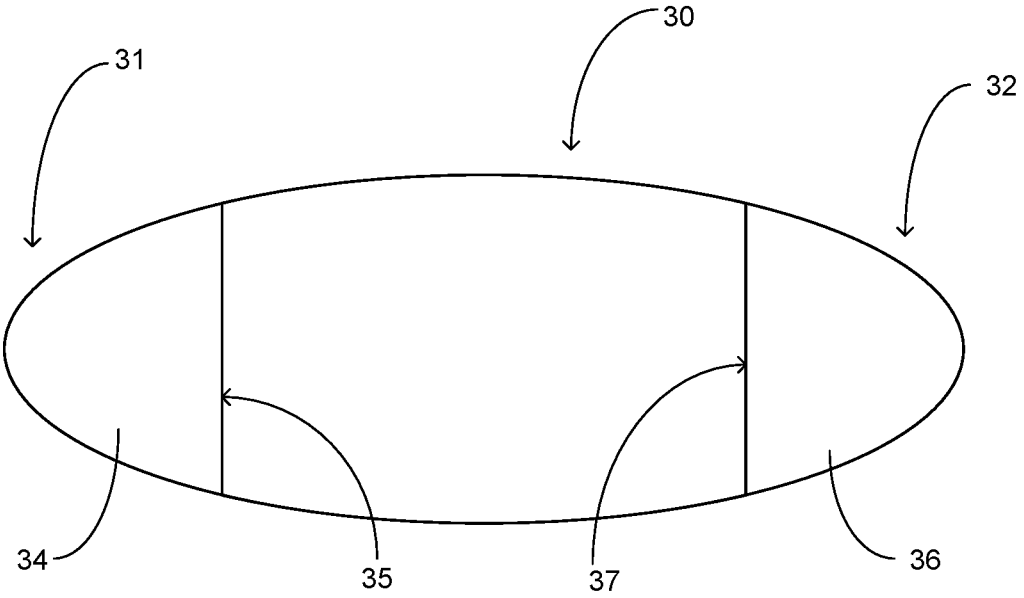
FIG. 2 is a top view of an embodiment of the secondary support member of the present invention.
Figure 3:
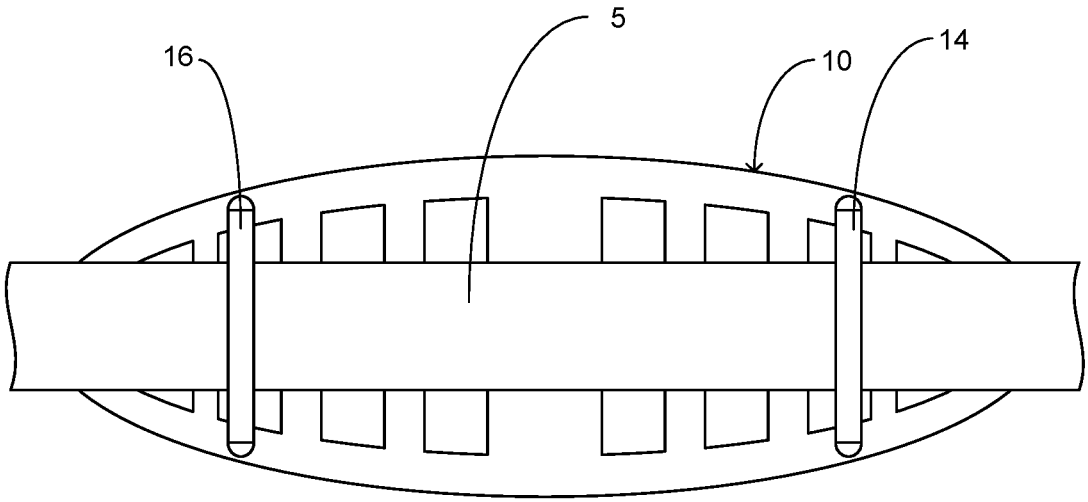
FIG. 3 is a top view of an embodiment of the first support member of the present invention operably coupled to the primary strap member.
Figure 4:
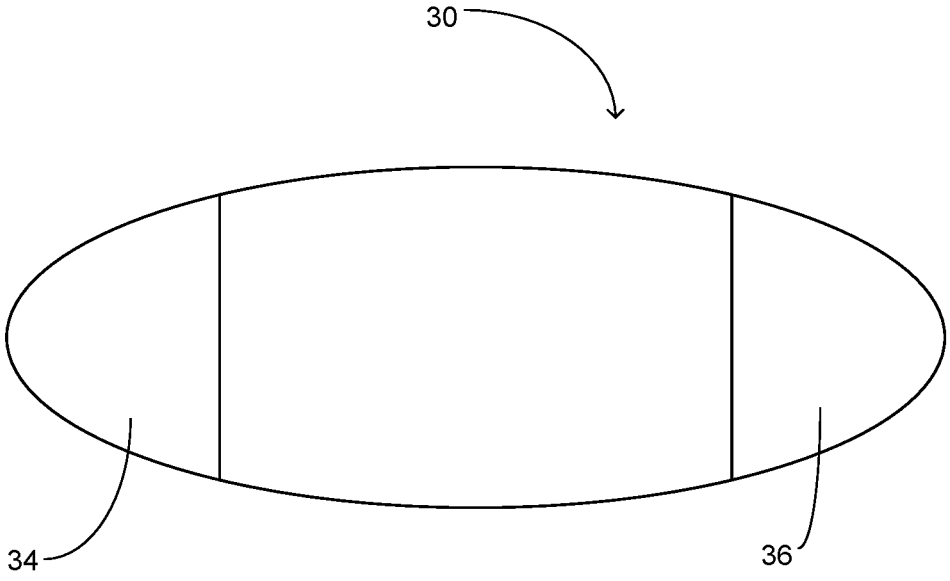
FIG. 4 is a top view of an embodiment of the secondary support member of the present invention.
Figure 5:
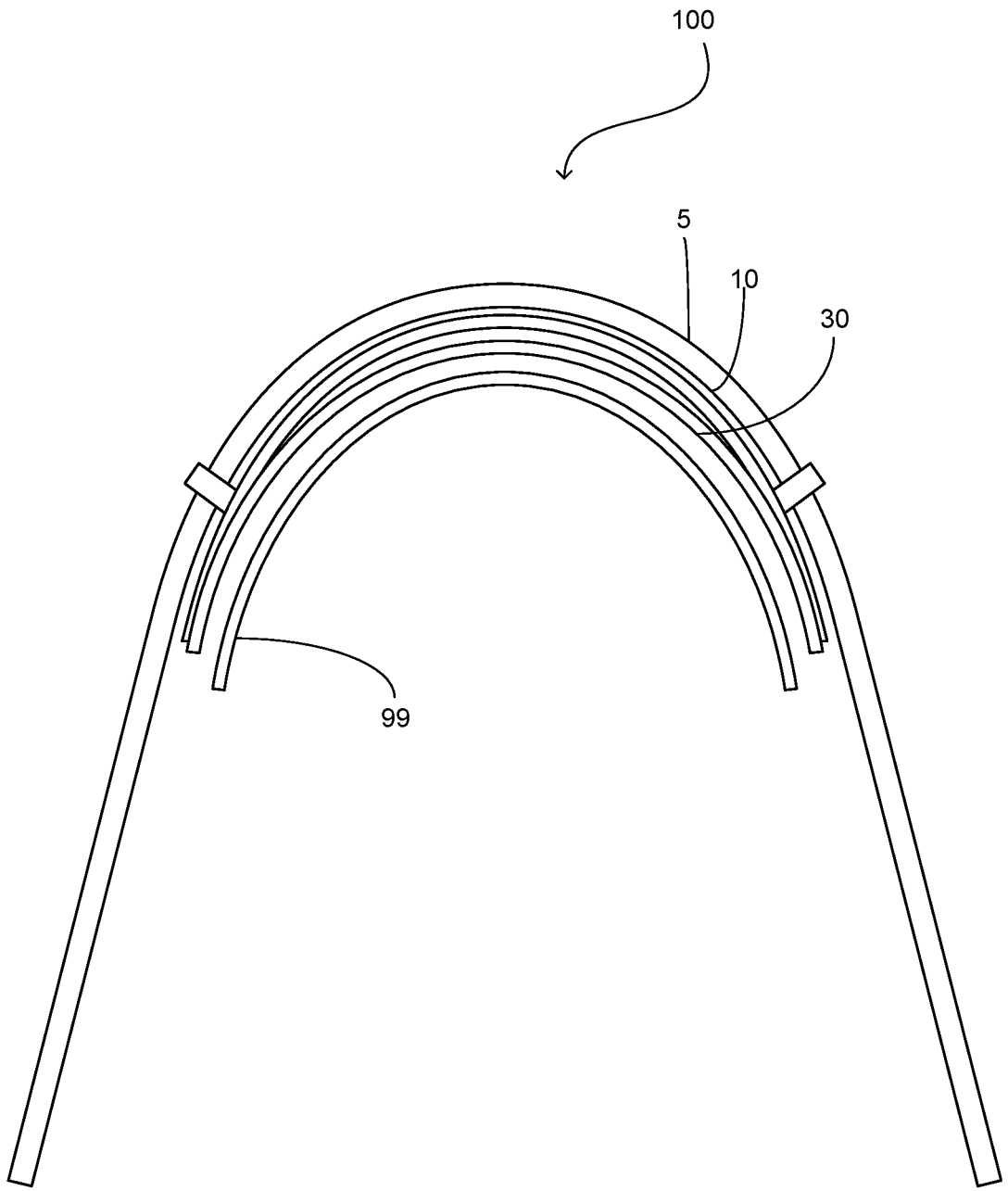
FIG. 5 is a side diagrammatic view of the present invention over a shoulder.
Figure 6:
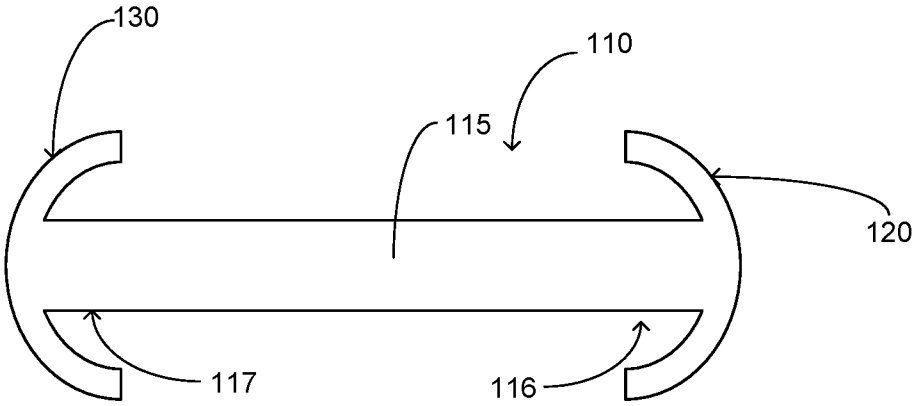
FIG. 6 is an alternate embodiment of the first support member of the present invention.
Figure 8:
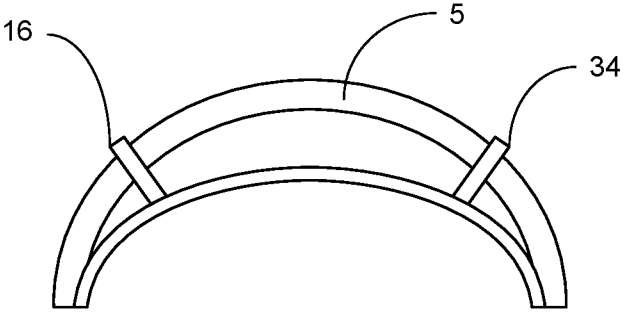
FIG. 8 is a side diagrammatic view of the alternate embodiment of the first support member coupled to the primary strap member.
Figure 7:
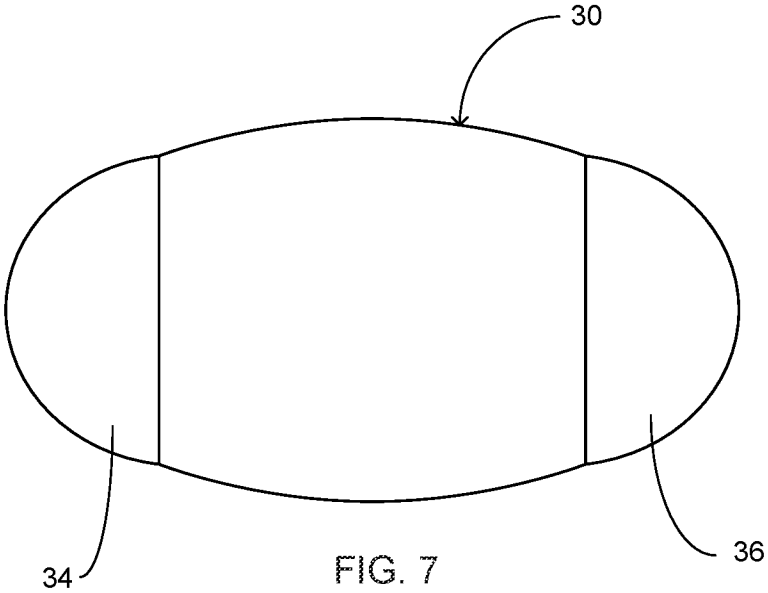
FIG. 7 is a top view of an embodiment of the secondary support member of the present invention.
Figure 9:
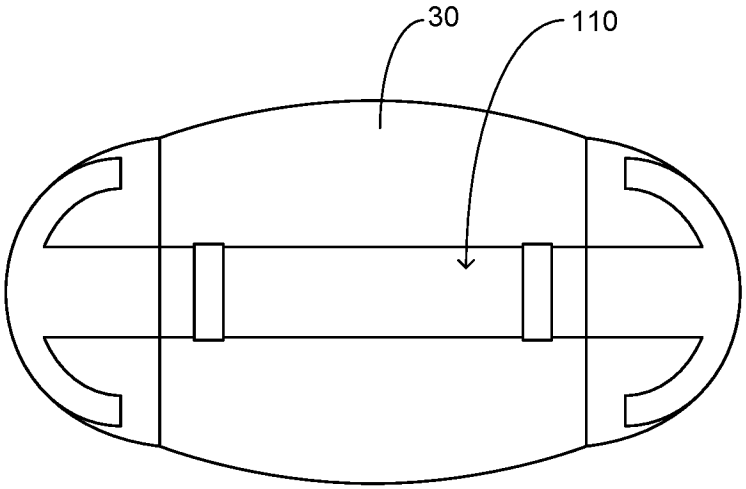
FIG. 9 is a top diagrammatic view of the alternate embodiment of the first support member coupled with the secondary support member.

Illustrated in FIG. 2 herein is the secondary support member 30. The secondary support member 30 is mateably shaped with the first support member 10 and is configured to be operably coupled thereto. The secondary support member 30 is planar in manner having a first end 31 and a second end 32. A first receiving pocket member 34 is present at the first end 31 and a second receiving pocket member 36 is present at the second end 32 of the secondary support member 30. Openings 35, 37 provide the structure to journal thereinto the first end 11 and second end 12 of the first support member 10. The secondary support member 30 has a length that is less than that of the first support member 10. As a result of the length differential, the first support member 10 is forced into an arcuate form ensuing being operably coupled to the secondary support member 30. Placing the first support member 10 in the aforementioned position and in conjunction with the structure of the first support member 10, the load bearing on the primary strap member across the shoulder 99 is transferred across a greater surface area of the shoulder 99 instead of being primarily at the top thereof. The force of the load is transferred into the ends 11, 12 and as such decreases the load at a midpoint of the shoulder 99.

FIG. 6 through FIG. 9 illustrates therein an alternative embodiment of the first support member 110 and its operable engagement with the secondary support member 30. The first support member 110 includes a central support member 115 having a first end 116 and a second end 117. The first support member 110 is manufactured from a semi-rigid material such as but not limited to plastic. It should be understood within the scope of the present invention that the first support member 110 could be manufactured from various different materials that have the properties to permit bending thereof so as to operably couple to the secondary support member 30. The first support member 110 includes a first end member 120 and a second end member 130 contiguously formed on the first end 116 and second end 117 of the central support member 115 respectively. The first end member 120 and second end member 130 are identical being arcuate in shape in the preferred embodiment. The first end member 120 and second end member 130 are configured to be inserted into the first receiving pocket member 34 and second receiving pocket member 36 respectively. The first support member 110 has a length that is greater than that of the secondary support member 30 so as to place in an arcuate or bowed position subsequent operable coupling of the first support member 110 to the secondary support member 30. As discussed herein, the arcuate shape of the first support member provides load distribution of the force being applied thereto by the primary strap member 5.

Figure 10:
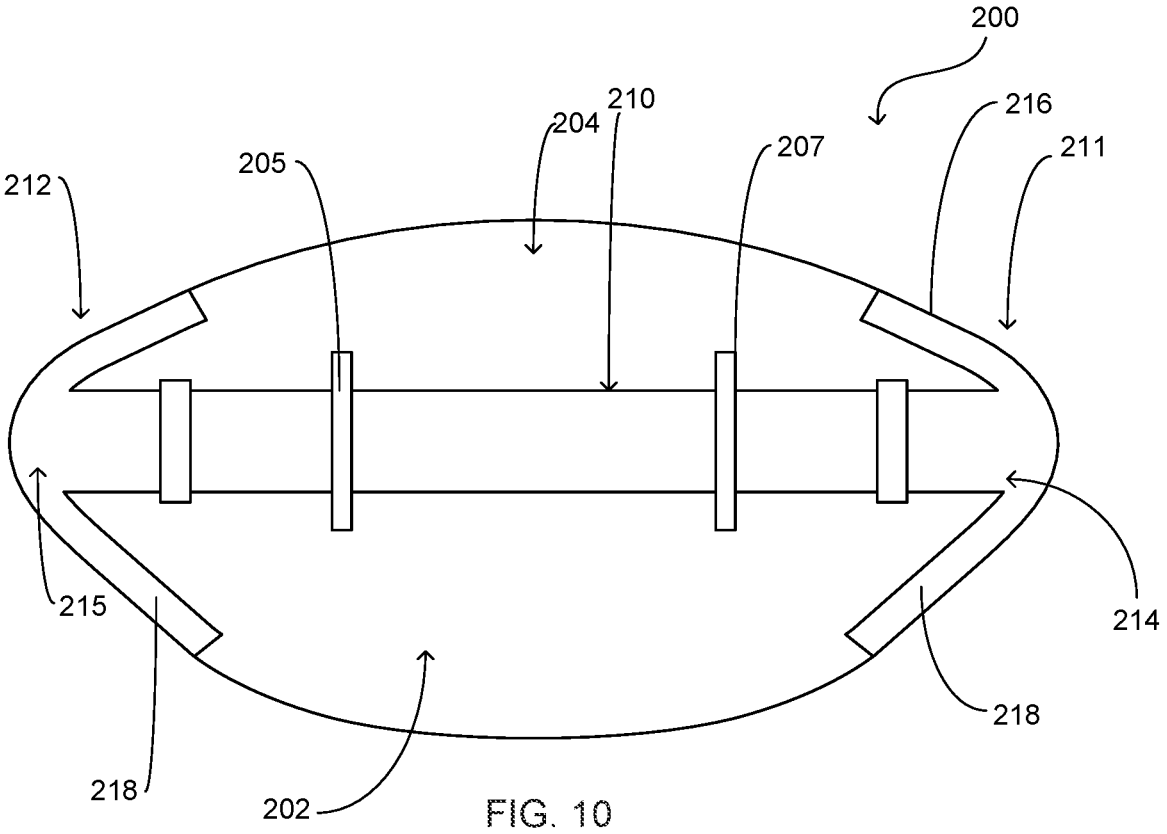
FIG. 10 is a top diagrammatic view of an additional embodiment of the first support member operably coupled with the secondary support member in a right shoulder configuration.
Figure 11:
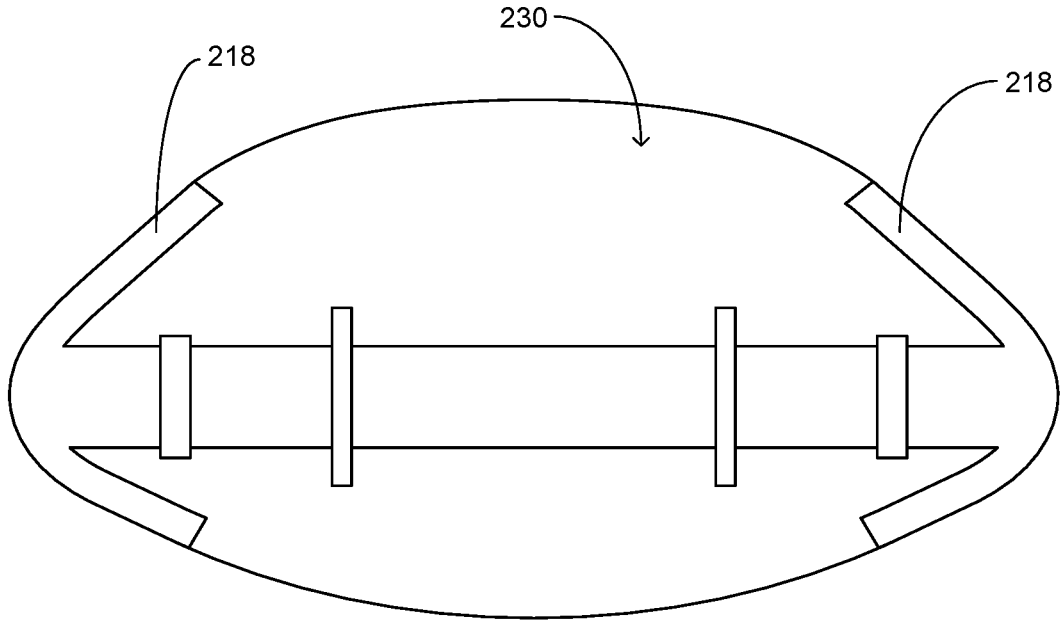
FIG. 11 is a top diagrammatic view of an additional embodiment of the first support member operably coupled with the secondary support member in a right shoulder configuration.

Referring now to FIG. 10 and FIG. 11, an alternative embodiment of the shoulder strap 200 is illustrated therein. The shoulder strap 200 includes first support member 210 that is configured to be operably coupled to secondary support member 230 employing securing members 205,207. The first support member 210 is releasably secured to the secondary support member 230 utilizing suitable techniques. The secondary support member 230 has a length that is less than that of the first support member 210 as is discussed herein with shoulder strap 100. The length differential places the first support member 210 in a arcuate or bowed position ensuing operable coupling with the secondary support member 230. As with the shoulder strap 100, this formation acts as a spring force to provide load distribution to the ends 211, 212 of the first support member 210 and reduces load force proximate the midpoint of the first support member 210 in order to more effectively distribute the load force over a greater area of the shoulder.

The secondary support member 230 is manufactured in an offset oval shape in order to engage a greater surface area of the shoulder of the user of the shoulder strap 200. The secondary support member 200 illustrated in FIG. 10 is an exemplary configuration to be placed on a right shoulder of a user. Surface area 202 on the first side of the first support member 210 is greater than the surface area 204 on the second side of the first support member 210. This shape provides a greater surface area proximate the neck muscles of the user of the shoulder strap 200. FIG. 10 illustrates the orientation for use on the left shoulder of a user providing the same functionality for the left shoulder as discussed for the right shoulder.

The first support member 210 includes end members 214, 215 wherein the end members 214, 215 have leg members 216,218 that are different in length. The leg members 218 are greater in length as these leg members 218 are proximate the shoulder/neck area of the wearer and as such a greater length is employed for load distribution in the area of the user proximate the neck. It is contemplated within the scope of the present invention that an anti-slip material is present on the surface of the secondary support member 30, 230 so as to inhibit movement thereof during engagement with the shoulder of the user. By way of example but not limitation, the secondary support member 30,230 could have silicone on the lower surface thereof.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A shoulder strap configured to provide load distribution across a shoulder of a user wherein the shoulder strap comprises:

a first support member, said first support member having a central support member, said central support member having a first end and a second end, said first support member having a first end formed on said central support member, said first end of said first support member being arcuate in shape, said first support member having a second end formed on said second end of said central support member, said second end of said first support member being arcuate in shape;

a secondary support member, said secondary support member being planar in manner and being oval in shape, said secondary support member having a first end and a second end, said first end of said secondary support member having a first receiving pocket member formed thereon, said second end of said secondary support member having a second receiving pocket member formed thereon, said first receiving pocket member configured to have said first end of said first support member inserted thereinto, said second receiving pocket member configured to have said second end of said first support member inserted thereinto; and a primary strap member, said primary strap member having a first end and a second end, said primary strap member being superposed said first support member opposite said secondary support member, said first end and said second end of said primary strap member being operably coupled to an item to be carried by the user.

2. The shoulder strap configured to provide load distribution across the shoulder of a user as recited in claim 1, wherein said secondary support member has a length that is less than that of a length of the first support member.

3. The shoulder strap configured to provide load distribution across the shoulder of a user as recited in claim 2, wherein said first support member is placed in an arcuate form subsequent being operably coupled to said secondary support member.

4. The shoulder strap configured to provide load distribution across the shoulder of a user as recited in claim 3, wherein said secondary support member further includes silicone disposed on a lower surface thereof.

5. A shoulder strap configured to provide load distribution across a shoulder of a user wherein the shoulder strap comprises:

a first support member, said first support member having a central support member, said central support member having a first end and a second end, said first support member having a first end member formed on said central support member, said first end member of said first support member having a first leg member and a second leg member, said first leg member extending outward from a first side of said central support member, said second leg member extending outward from a second side of said central support member, said central support member having a second end member formed on said second end thereof, said second end member having a first leg member and a second leg member, said first leg member of said second end member extending outward from the first side of said central support member, said second leg member of said second end member extending outward from the second side of said central support member;

a secondary support member, said secondary support member being planar in manner, said secondary support member having a first end and a second end, said secondary support member having a first surface area and a second surface area, said first surface area being smaller than said second surface area; and a primary strap member, said primary strap member having a first end and a second end, said primary strap member being superposed said first support member opposite said secondary support member, said first end and said second end of said primary strap member being operably coupled to an item to be carried by the user.

6. The shoulder strap configured to provide load distribution across the shoulder of a user as recited in claim 5, wherein said first leg member of said first end member and said first leg member of said second end member have a length that is less than that of a length of the second leg member of the first end member and the second leg member of the second end member.

* * * * *